US005427343A

United States Patent [19]

Ferris

[11] Patent Number: 5,427,343

[45] Date of Patent: Jun. 27, 1995

[54] PLASTIC CONTAINER HANGER

[76] Inventor: Shel Ferris, 1455 Holly Heights Dr. Unit 38, Fort Lauderdale, Fla. 33304

[21] Appl. No.: 174,290

[22] Filed: Dec. 28, 1993

[51] Int. Cl.[6] ..... A47K 1/00

[52] U.S. Cl. ..... 248/215; 215/399; 248/311.3; 248/340; 248/692

[58] Field of Search ..... 248/215, 216.1, 216.4, 248/227, 304, 311.3, 339, 340, 684, 690, 692, 686; 215/100 R, 100 A; 206/806; 220/751

[56] References Cited

U.S. PATENT DOCUMENTS

| | | | |
|---|---|---|---|
| 1,246,197 | 11/1917 | Welcome | 248/684 |
| 1,767,897 | 6/1930 | Roman et al. | 248/339 X |
| 2,232,094 | 2/1941 | Canfield | 248/339 |
| 2,705,385 | 4/1955 | Markward | 248/215 |
| 3,224,721 | 12/1965 | Malmquist | 248/339 |

*Primary Examiner*—Ramon O. Ramirez
*Attorney, Agent, or Firm*—Malin, Haley, DiMaggio & Crosby

[57] ABSTRACT

A container hanger for manual attachment to a conventional plastic bottle such as a shampoo bottle at its flat end portion which allows the support device to be fastened by screwing into the base of the container and hung inverted from a towel rack or shower pipe, thereby allowing easy access to the fluid within the container while greatly organizing a bathroom area to keep containers off the counter top surfaces and floors. The support device includes a self-drilling threaded fastener for manual insertion and attachment to the plastic container.

3 Claims, 3 Drawing Sheets

PLASTIC CONTAINER HANGER

BACKGROUND OF THE INVENTION

1. Field of the Invention

This invention relates generally to a reusable hanger that can be manually affixed to a plastic container, and in particular, to a manually attachable hanger that is used to support a plastic container typically containing shampoos, soaps or the like for use in a shower area to facilitate dispensing of the liquids in an inverted position from the plastic container.

2. Description of the Prior Art

In many households the bathroom shower area is often littered with various plastic containers housing soaps, shampoos, conditioners and other liquids which are used by a person during a shower. Typically, the containers are stacked or placed in the shower area on shelves or on the shower floor itself resulting in an array of unsightly containers and clutter. Also, the containers are not readily accessible for use in the shower area and often spill their contents as a result.

The present invention overcomes these problems by providing a reusable hanger that can be manually and quickly affixed to the base of a plastic container, such as a shampoo container. Once the present invention is attached to the container, the container can be hung by the hook from a shower discharge pipe or towel rack in an inverted position so that the spout or outlet from the container faces downward allowing its contents to be dispensed. Thus, the present invention provides for the organized and convenient arrangement of loose containers, such as shampoo or conditioning containers, in a bathroom area. In addition, the present invention may be readily and manually removed for reuse with another container once the contents of a previous container have been depleted.

SUMMARY OF THE INVENTION

The subject invention provides an attachable hanging apparatus for supporting a plastic container, such as a shampoo container, and comprises a rigid tubular body having a relatively straight portion, a curved portion and a threaded fastener connected at one end of the tubular body. The curved portion may form a partial S-curve at the upper end blending into the relatively straight portion which terminates with a bottom or end surface. The threaded fastener attaches substantially perpendicular to the bottom surface.

The threaded fastener includes a single screw body with threads that may be pointed and that is capable of being screwed into the plastic, and more particularly, into the base of a plastic container. The threaded fastener that is exposed includes a shaft or shank portion that itself is embedded within the body of the device so that it is rigidly attached to the body of the device.

With respect to the rigid body which is preferably made of a molded plastic, the radius of curvature of the opening is sized so that it will fit around objects such as a 1" pipe found connected to shower heads or towel rack bars which could be 1" to 2". Therefore, the opening on the hook portion should be sized to fit around at least the 2" diameter bar or pipe.

Although the preferred embodiment shows a curved arcuate hook portion which allows the center hook portion to slide to its final position around any type of bar or pipe, it is possible that the hook portion could be of a different shape such as a rectangle so that it can engage the bar or pipe.

In a preferred embodiment, a center line could be drawn vertically from the hook curvature in linear alignment with the shaft body of the threaded fastener so that an approximate radial center of the curved portion would cross the line extending from the threaded fastener. This allows a certain offset relative to the unit's center of gravity for allowing the container to hang vertically instead of angularly.

To utilize the present invention, a plastic container such as a shampoo bottle or container is selected. The present invention is grasped in one hand while the shampoo bottle is grasped in the other hand with the bottom facing up. The threaded fastener of the invention is then screwed into the bottom surface of the shampoo container piercing into the plastic and firmly attaching the device to the container.

To operate and dispense liquid, the container is attached to the hook, hung in place in an inverted manner, and opened by the cap of the container for dispensing the liquid therein while the device remains hanging. The entire unit could also be removed from its hanging position, manipulated by hand for dispensing the liquid and then returned to the rack bar or pipe in the inverted position with the cap closed. Once the contents of the plastic container have been expended, the hook can be manually removed by rotating the container or the hook to remove the threaded fastener from within the container body. This detaches the hook and fastener from the container which can then be discarded. The length of the threaded fastener is such that it need only be sufficient to attach firmly into the plastic container. The present fastener is approximately ½" long with an additional ½" embedded in the body of the device. The end face may be made flat where the threaded fastener protrudes perpendicularly outwardly so that the end face of the hook body can be screwed in place and be flush with the container bottom to firmly hold the hook in place.

It is an object of this invention to provide an improved support device for plastic containers such as shampoo bottles in the bathroom area.

It is another object of this invention to provide an attachable and removable hook or supporting device that can be used with a plastic container for hanging or suspending the plastic container in a bathroom area.

It is an additional object of this invention to provide a reusable hanger for containers that is low in cost and simple to manufacture.

In accordance with these and other objects which will become apparent hereinafter, the instant invention will now be described with particular reference to the accompanying drawings.

DESCRIPTION OF THE PREFERRED EMBODIMENTS

Figure 1:
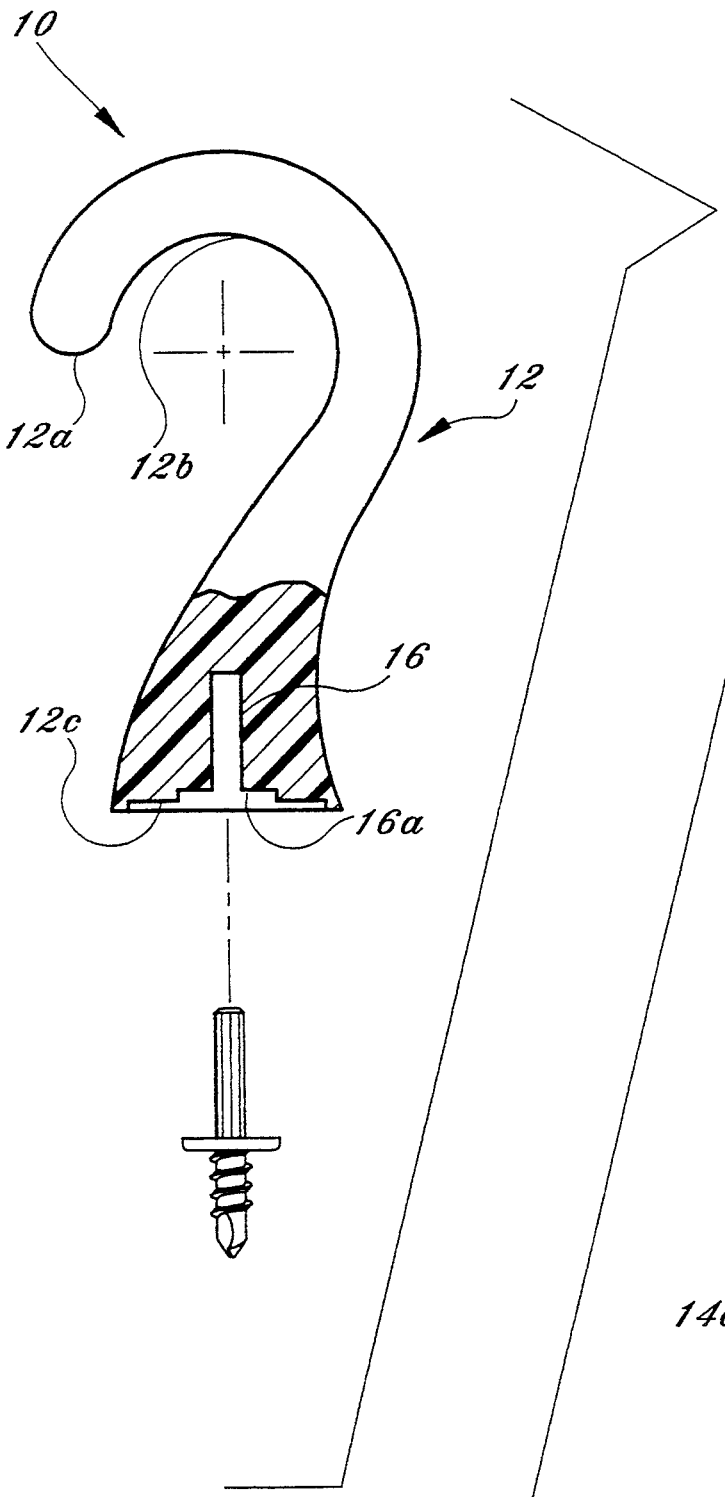
FIG. 1 shows a side elevational view of the present invention partially in cross section and exploded.
Figure 2:
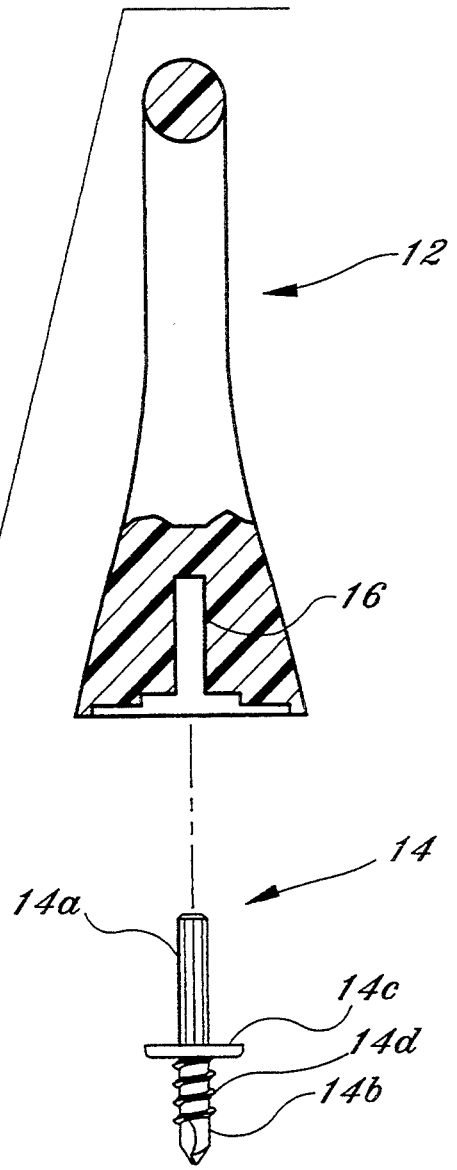
FIG. 2 shows a front elevational view of the present invention partially in cross section and exploded.

Referring now to the drawings and in particular FIG. 1, the present invention is shown in FIGS. 1, 2 and 6 comprising a rigid body 12, preferably made of a molded plastic, that has a flat end base portion 12*c* that extends as a tapered tube from the flat end portion 12*c* into a curved portion 12*b* forming a radius with an enlarged opening between a smaller tubular end 12*a* and the large base end. FIG. 1 and 2 show in cross section a pilot hole that has a first narrow cylindrical shaft 16, a cylindrical larger portion 16*a* and then a large end base portion 12*c* with a self drawn fastener 14 that is threaded and fits perpendicular into the base 12*c* of the hook body. The narrow cylindrical shaft 16 is narrower in diameter then fastener 14 which includes spine teeth 14*a* longitudinally along a portion of the fastener body 14 so that it is driven by force into shaft 16 of the hook body 12, rigidly attaching the fastener to the hook. The annular flange 14*c* is a base plate that stops the inward movement of fastener 14 and fits flush in the recessed portion 16*a*. Hence, the fastener 14 fits snugly into the end piece 12*c* of body 12. FIG. 2 shows the circular cross section of the body 12 which tapers outwardly as it gets towards the end base.

Figure 3:
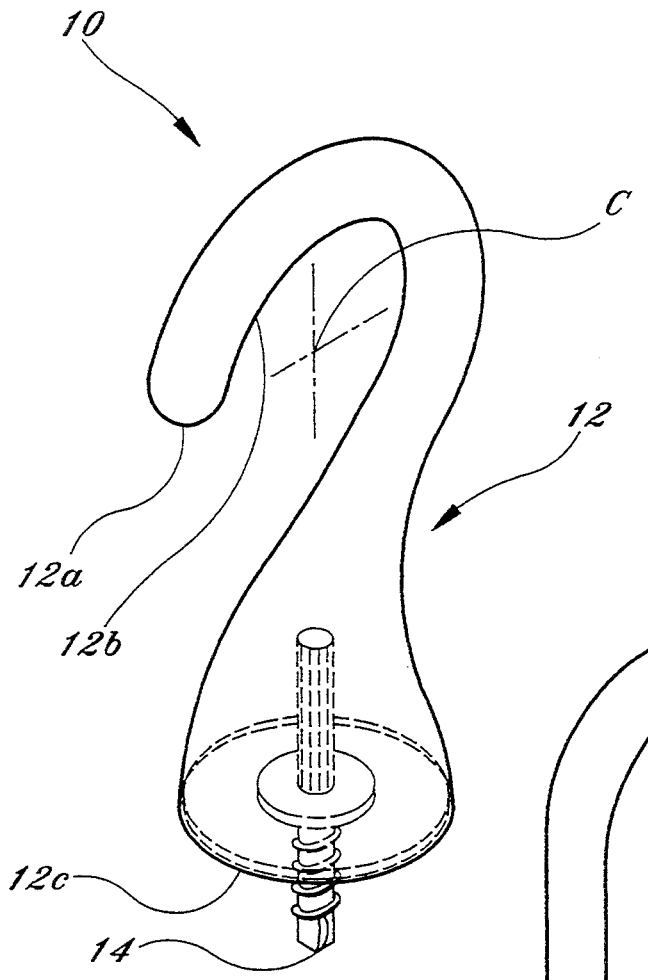
FIG. 3 shows a perspective view of the present invention partially in phantom.

The preferred embodiment teaches one method of attaching the fastener 14 to the hook body 12, that is by insertion into the pilot hole 16. The fastener 14, however, could be inserted into the hook body mold and manufactured in place together with the hook body during the molding operation so that the entire fastener is molded into one piece. In any event, the fastener 14 includes threaded screw threads 14*d* and a self-tapping or self-drilling tip 14*b* that will allow the threaded portion to be screwed into a flexible plastic container, such as a shampoo bottle at its bottom surface. The annular flat disk shape flange 14*c* will also act along with the flat bottom 12*c* of the hook to firmly engage the exterior bottom surface of a plastic bottle to firmly hold the hook body through the fastener that is threaded in the plastic bottle body. This allows the entire plastic bottle container to be inverted and hung by the hook body to a towel rack or shower pipe. FIG. 3 shows a perspective view of the present invention 10 made up of hook body 12 which includes a narrow end tip 12*a* and an arcuate curved radius portion 12*b* having a radius center shown by the letter C and the flat end surface 12*b*, along with fastener 14 rigidly attached thereto.

Figure 4:
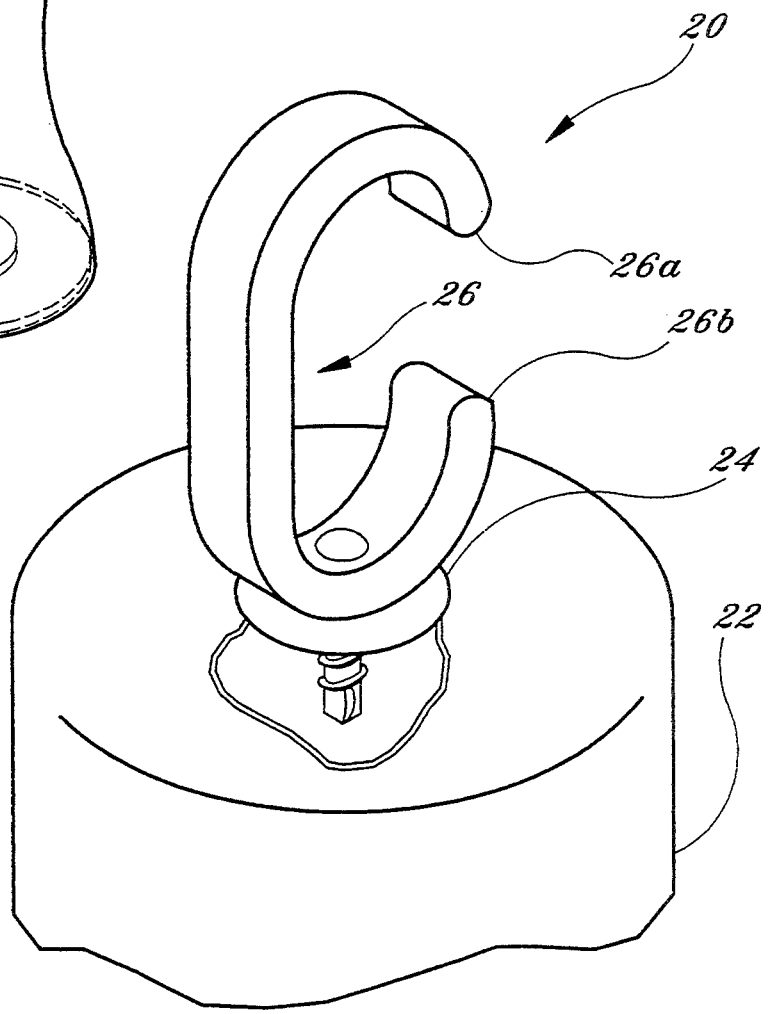
FIG. 4 shows a perspective view of an alternative embodiment of the present invention in use with a plastic bottle

FIG. 4 shows an alternative embodiment of the instant invention, depicted as 20, wherein the upper curved hook portion has a center interior radius throughout the curved portion and a vertical center line that corresponds with the longitudinal center line of the fastener 24. The body of the preferred embodiment is replaced with a C-shaped hook 20 that includes a C-shaped plastic molded body (or other suitable material) 26 having affixed at one end a fastener 24. The fastener 24 of the alternative embodiment includes, as it does in the preferred embodiment shown in FIG. 2, the threaded self-tapping or self-drilling screw portion, the annular flat disk flange and the spine teeth portion that rigidly attaches to body 26. The C-shaped hanger 20 includes a first end 26*a* and a second end 26*b* that create and define an opening sized greater than the diameter of a shower conduit, or pipe, or a towel rack, so that the C-shaped body can fit over the towel rack. As shown in FIG. 4, the device 20 is attached to a typical plastic bottle 22 at its base.

Figure 5:
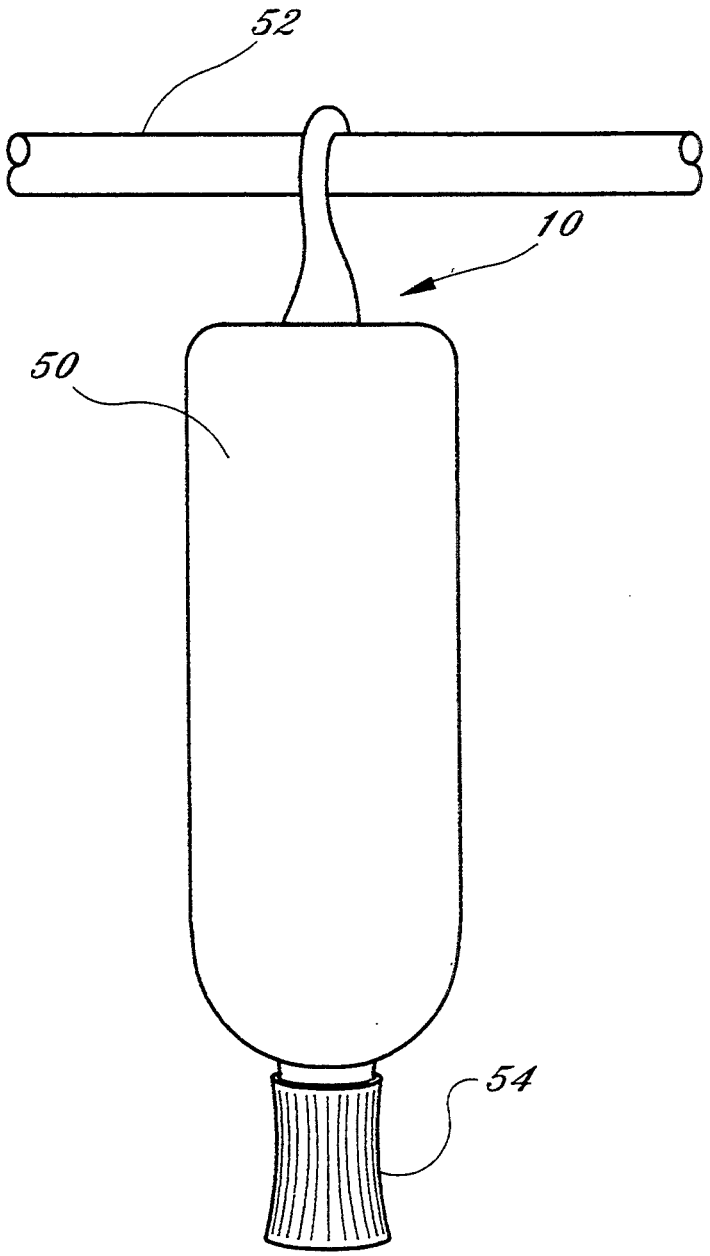
FIG. 5 shows a perspective view of the preferred embodiment of the present invention in use with a plastic bottle.

Referring now to FIG. 5, the device as shown includes the invention 10 and the hook body which is attached to a shampoo bottle 50 that is inverted that has a cap 54 for opening to dispense fluid from therein. The device 10 is hung from a towel rack 52 illustrating how it would be used in its normal mode of operation.

To use the invention, one can either remove it from the towel rack 52 open the cap 54 and squeeze the bottle 50 for expelling shampoo or other chemicals or fluids therein. The device could also be left on the towel rack and the cap 54 opened to expel the fluid in the same manner without removing the unit from the towel rack.

With the use of the present invention, once shampoo or other fluid is expended from the flexible plastic bottle or container the hook is then manually screwed in the opposite direction allowing it to be separated from the shampoo bottle and reused on another new, full bottle. With the use of the present invention, the bathroom areas organization can be greatly enhanced by eliminating numerous bottles sitting around on counter tops or shower floors. Hence, bathroom paraphernalia may be placed in an out of the way position to allow for a more aesthetically pleasing bathroom area without having to move numerous shampoo or conditioning bottles. The devices are preferably made of a durable molded plastic with a stainless steel insert fastener for durability.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A support device for supporting a container from a conduit or towel rack in an inverted position, said support device comprising:

a body member having at least one arcuate hook shaped portion at one end for mounting to the conduit or towel rack, and a bottom end wherein said body member defines a pilot hole;

an elongated screw body having a shaft with an upper end and a lower end, and a flange centrally disposed between said upper end and said lower end;

said upper end having a plurality of spine teeth for anchoring said screw body upper end within the pilot hole defined by said body member;

said shaft lower end including a plurality of threads and a self-tapping end tip to facilitate secured fastening of the container to said body member.

2. A support device for supporting a plastic container from a conduit or towel rack in an inverted position, said support comprising:

a body member having at least one arcuate hook shaped portion at one end for mounting to said conduit or rack, said body member having a bottom end;

an elongated screw body for threadably attaching the flexible container to said body member for supporting the container when said body member is mounted to the conduit or rack, said screw body having a shaft with an upper end and a lower end, a disc shaped flange centrally disposed between said lower end and said upper end, said lower end including a plurality of threads and a self-drilling end tip;

means for the secured fastening of said screw body to said body member, said secured fastening means comprising a plurality of spine teeth disposed around said upper end and a pilot hole defined by said body member at said bottom end, said pilot hole having a first narrow cylindrical shaft for mating with said upper end and a second larger cylindrical shaft concentrically disposed below said first shaft for mating with said flange.

3. A container for housing a liquid that can be supported from a shower rack or pipe comprising:

plastic container body having a bottom and a dispensing end;

a hook body, attached to the bottom of said container body by a fastener, for hanging said container body in an inverted configuration;

said fastener having a top end including a plurality of spine teeth, said hook body defining a pilot hole at said bottom end for mating with said fastener, whereby said fastener can be mounted by force and attached to said hook body along said spine teeth in said pilot hole;

said fastener having a bottom end with a self-tapping tip and a plurality of threads such that said hook can be removably screwed into the bottom of said plastic container;

a cap attached to the dispensing end of said container body for selectively dispensing liquids.

* * * * *